United States Patent [19]

McLeod et al.

[11] Patent Number: 5,010,908

[45] Date of Patent: Apr. 30, 1991

[54] APPARATUS FOR CLEANING THE INTERIOR OF ELONGATED TUBULAR OBJECTS

[75] Inventors: Andrew E. McLeod; Gaines C. Fields, both of Kingsport, Tenn.; Donald J. Sanders, Gate City, Va.

[73] Assignee: Eastman Kodak Company, Rochester, N.Y.

[21] Appl. No.: 471,580

[22] Filed: Jan. 29, 1990

[51] Int. Cl.[5] ..... B08B 3/02; B08B 9/04

[52] U.S. Cl. ..... 134/168 C; 91/417 R; 134/178; 239/239; 239/DIG. 10

[58] Field of Search ..... 134/167 R, 167 C, 168 R, 134/168 C, 178; 166/185, 187; 239/DIG. 13, 239, 263; 118/DIG. 10, 317; 91/417 R; 122/390, 391, 392; 165/95; 15/304, 316 R

[56] References Cited

U.S. PATENT DOCUMENTS

| | | | |
|---|---|---|---|
| 646,458 | 4/1900 | Pedrick | 91/417 R X |
| 995,900 | 6/1911 | Plecher et al. | 239/239 X |
| 1,854,471 | 4/1932 | Hofmann | 15/304 X |
| 1,982,590 | 11/1934 | Church et al. | 15/316 R X |
| 2,803,842 | 8/1957 | Fuller | 15/304 X |
| 3,791,583 | 2/1974 | Nunlist et al. | 239/227 |
| 4,225,362 | 9/1980 | Sentell | 134/24 |
| 4,605,028 | 8/1986 | Paseman | 134/167 C |

*Primary Examiner*—Philip R. Coe

*Attorney, Agent, or Firm*—John F. Stevens; William P. Heath, Jr.

[57] ABSTRACT

Disclosed is an apparatus for cleaning the interior of elongated tubular objects such as pipes, tubes, etc., using a reciprocating lance having a cleaning fluid spray head at its end. Fluid pressure provides reciprocating movement to the lance. The cleaning fluid pressure is independent of the fluid which provides movement to the lance, thereby maintaining the desired fluid pressure to the nozzle through the complete cycle of reciprocation.

2 Claims, 2 Drawing Sheets

APPARATUS FOR CLEANING THE INTERIOR OF ELONGATED TUBULAR OBJECTS

TECHNICAL FIELD

This invention relates to an apparatus for cleaning the interior of elongated tubular objects such as pipes, tubes, etc., using a reciprocating lance having a spray nozzle at its end.

BACKGROUND OF THE INVENTION

Tubing such as used in heat exchangers often becomes blocked with material such as residue from water.

High pressure water is frequently used to clean the small diameter tubes found in such processing equipment as condensers and heat exchangers which tend to foul and clog with use. The high pressure water is directed against the tube walls with specially designed nozzles attached to the end of long hollow rods called lances. These lances are traversed through the fouled tubes either manually or with automatic devices. Conventional equipment is designed to use the cleaning fluid pressure as the hydraulic force to advance and retract the lance. But because the nozzle supply and the hydraulic supply are not separate systems, the nozzle can not build to high pressures unless the lance movement is mechanically stopped by the presence of a blockage in the tube. Therefore, this system works well to unclog tubes but can not adequately finish cleaning the tubes because of the lack of pressure. The present invention provides a lance which can be traversed while maintaining a high pressure water supply.

The current invention is a modification of the invention described by U.S. Pat. No. 4,225,362. The apparatus described therein consists of a long pipe or casing through which the nozzle, tube, and piston assembly reciprocate. Water is forced into the casing at the front end and applies pressure to the rear of the piston by flowing past the piston's outer diameter. This high pressure water also flows through the hollow piston and into the lance tubing and out the nozzle. As the piston moves forward it creates a vacuum in its wake that must be filled by the water supply and therefore causes a reduction in pressure at the nozzle. This reduced pressure causes a decreased flow through the nozzle and reduced cleaning. When the lance is mechanically stopped by a clog in the tube, the system pressure builds to a maximum.

U.S. Pat. No. 3,791,583 discloses apparatus in which a spray cleaning head is mounted on a reciprocating cleaning fluid supply tube extending from the open end of a hydraulic cylinder An annular piston on the tube, the tube itself, and the cylinder define an expansible chamber within the cylinder. A pump supplies cleaning fluid to the closed end of the hydraulic cylinder, whereby the cleaning fluid exerts pressure on the annular piston, and means are provided for supplying fluid to and draining fluid from the expansible chamber. The pressure exerted by the cleaning fluid on the annular piston moves the supply tube and the cleaning head from a retracted to an extended position when fluid is drained from the expansible chamber, and the supply tube and cleaning head are moved back to the retracted position when fluid is supplied to the expansible chamber.

In the '583 patent, the cleaning fluid is also the fluid which provides pressure for reciprocating the lance. In the present invention, the cleaning fluid pressure is independent of the fluid which provides reciprocating movement of the lance, thereby maintaining the desired fluid pressure to the nozzle through the complete cycle of reciprocation.

DESCRIPTION OF THE INVENTION

According to the present invention, there is provided an apparatus for cleaning the interior of elongated tubular objects with pressurized fluid comprising:

(a) a cylinder having opposite closed ends, (b) a double-acting piston mounted for reciprocating motion in said cylinder defining variable volume chamber at each end of said cylinder, (c) a hollow rod fixed to the piston and extending coaxially with the cylinder through an end thereof, said rod having a nozzle at the end thereof outside said cylinder and openings therein for allowing passage of fluid from said cylinder to the inside of said hollow rod, (d) means providing a fluid seal between said rod and said cylinder end, (e) means for independently selectively supplying fluid under pressure to each side of said piston, (f) means for independently selectively discharging fluid from each side of said cylinder, and (g) valve means for independently selecting the supply or discharge of liquid from each chamber of said cylinder.

According to a preferred embodiment of the present invention, there is provided an apparatus for cleaning the interior of elongated tubular objects with pressurized fluid comprising:

(a) a cylinder having opposite closed ends, (b) a double-acting piston mounted for reciprocating motion in said cylinder defining variable volume chamber at each end of said cylinder;

(c) a hollow rod fixed to the piston and extending coaxially with the cylinder through an end thereof, said rod having a nozzle at the end thereof outside said cylinder and openings therein for allowing passage of fluid from said cylinder to the inside of said hollow rod, (d) means providing a fluid seal between said rod and said cylinder end, (e) a first conduit for supplying pressurized fluid to the chamber of said cylinder through which the hollow rod extends.

(f) a second conduct for conducting pressurized liquid to and from the other chamber of said cylinder, (g) a connecting conduit having a valve connecting said first and second conduits, (h) said second conduit having a valve downstream from the junction with said connecting conduit, and (i) means for supplying fluid under pressure to said first conduit upstream from its junction with said connecting conduit.

Figure 1:
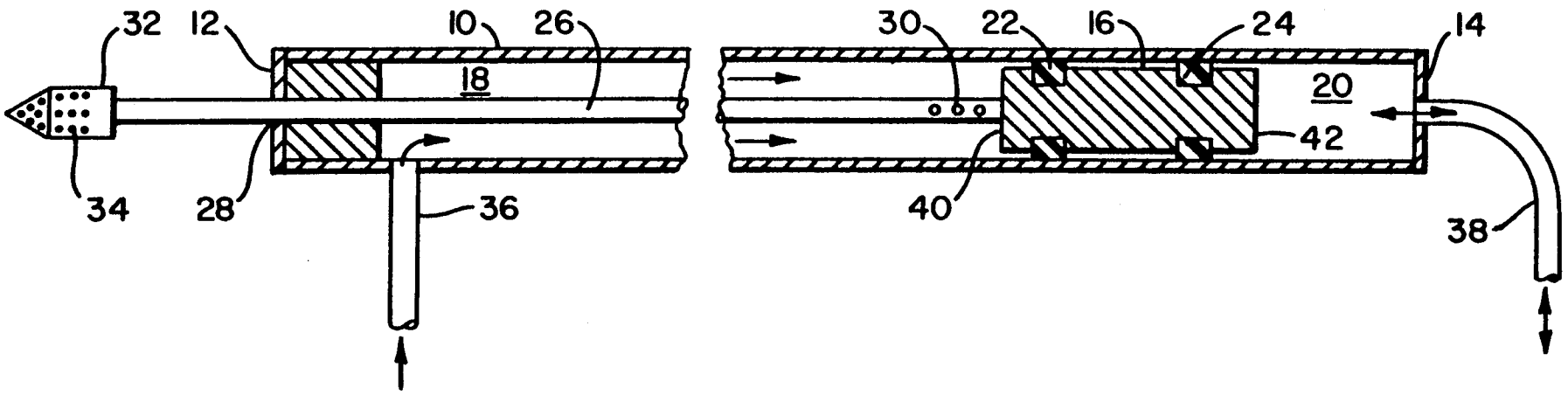
FIG. 1 is a schematic illustration of the cleaning apparatus according to the present invention.

Referring to the drawings, FIG. 1 in particular, the present apparatus for cleaning the interior of elongated tubular objects with pressurized fluid is illustrated. Cylinder 10 having opposite closed ends 12 and 14 houses a double-acting piston 16 which defines chambers 18 and 20 at opposite ends of the cylinder. Piston 16 is provided with fluid seals 22 and 24 between the outer surface of the piston and inner surface of the cylinder.

A hollow rod or lance 26 is fixed to piston 16 by conventional means and extends coaxially with cylinder 10 through chamber 18 and through end plate 12. Conventional fluid sealing means is provided between the hollow rod 26 and end plate 12 at 28. Hollow rod 26 is provided with one or more openings 30 to allow fluid transfer from chamber 18 to the interior of hollow rod 26. Hollow rod 26 is provided with a nozzle 32 at the end thereof outside the cylinder 10 containing openings 34 for spraying fluid which is transferred from chamber 18, through openings 30, through the inside of hollow rod 26 and finally through nozzle 32. Conduit 36 is provided for supplying fluid under pressure to chamber 18 and also draining fluid from chamber 18. Conduit 38 is provided for supplying fluid under pressure to chamber 20, and also for draining fluid from chamber 20.

A suitable source of fluid under pressure, conduit arrangement and valving arrangement are provided for causing piston 16 to reciprocate to thereby advance and retract nozzle 32, by means of differential fluid pressure acting on surfaces 40 and 42 respectively of piston 16. Fluid under pressure is always in chambers 18 and 20. However, by regulating the pressure in each chamber to cause pressure differentials between the chamber, pressurized fluid is constantly supplied to nozzle 32 while at the same time, the pressure differential causes reciprocation of piston 16.

With the current invention the system that supplies the nozzle and the fluid system that supplies the piston pressure are independent. Fluid is introduced at both ends of the casing. The nozzle fluid supply enters the lance tube through holes in the tube just below the piston. These holes remain unobstructed throughout the lance traverse. A second supply of fluid is introduced behind the piston. The piston is solid and contains two reciprocating seals, and therefore effectively seals the nozzle fluid supply from the piston pressure supply.

Figure 2:
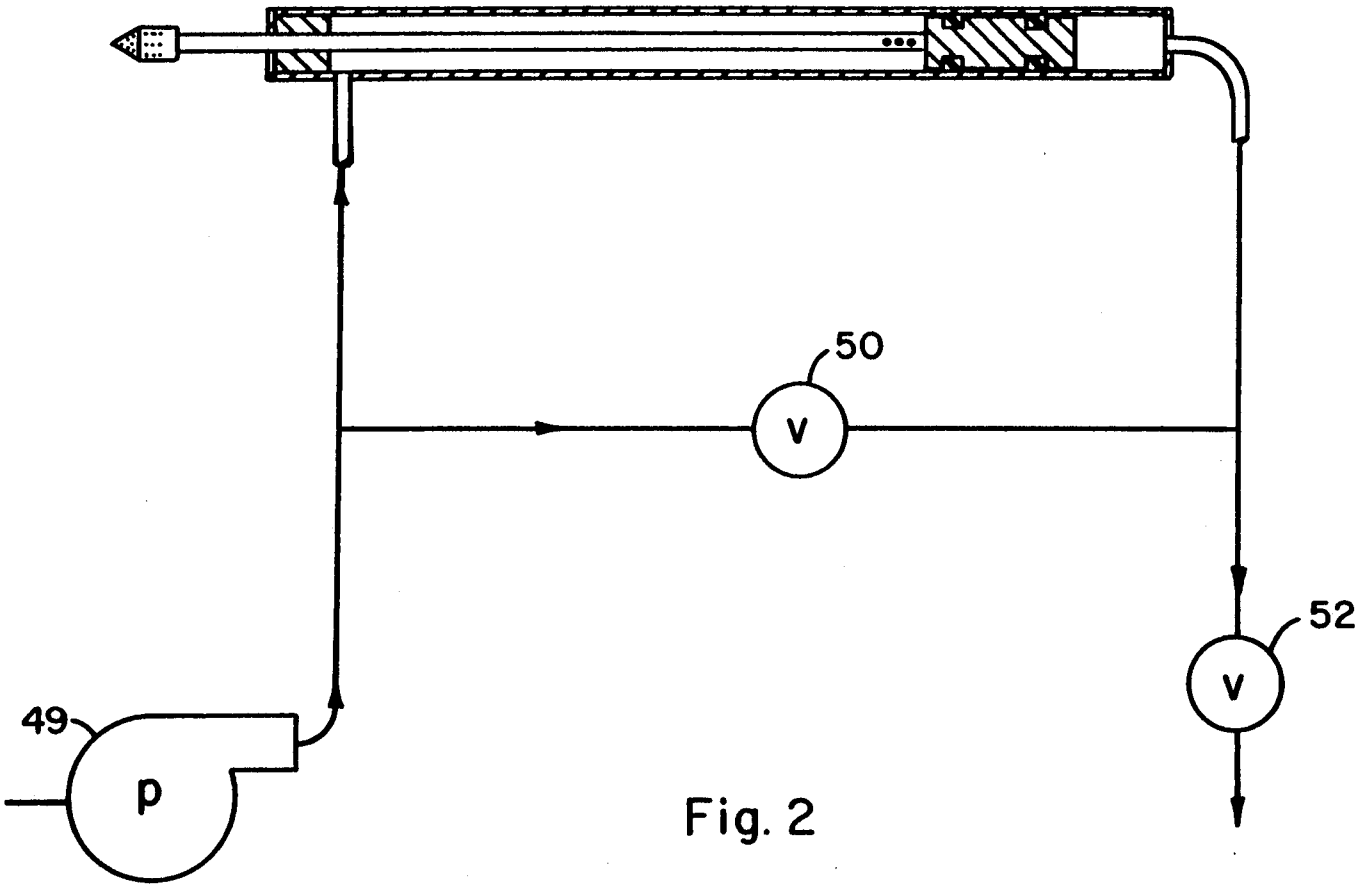
FIG. 2 is a diagram showing a suitable supply, conduit and valving arrangement for operating the apparatus of FIG. 1.

When a conduit and valving arrangement shown in FIG. 2 is used, the arrangement described above allows for almost independent control of the nozzle cleaning pressure (or the nozzle flow rate) and the lance traversing speed. To start a lance traverse, pump 49 is turned on with valve 50 closed and valve 52 open. Pressure builds in the nozzle supply system and the lance is forced to its fully retracted position. Then, if valve 52 is closed and valve 50 is opened, fluid flows behind the piston, and a pressure approximately equal to the pressure applied to the front of the piston is established. The pressure on the back face 42 of the piston 16 creates a force greater than the force on the front face 40 due to the larger effective surface area (The resultant force applied by the fluid in the lance tube is zero). This unbalanced force causes the piston/lance to advance. As it moves, its displacement must be replaced by fluid through conduit 38. The speed of the traverse can be adjusted by opening valve 50 to the desired level. The lance can be retracted at any time during the traverse by closing valve 50 and opening valve 52.

If only one traversing speed is required, the procedure described above can be simplified. Valve 52 can be kept fully closed. Valve 50 can then be opened until the correct speed is obtained. After full traverse, valve 52 can be opened to retract the lance. The throttling effect of valve 50 will provide sufficient pressure to the front of the piston to push the lance to its fully retracted position.

The current design is desirable because it allows the use of any nozzle, and the lance can be traversed at any desired speed while maintaining maximum pressure to the nozzle.

Another means for speed control may be mechanical control of the lance. These devices can provide the same performance as the current invention but require more complex moving parts and present many more maintenance problems.

The current invention is conveniently designed for a maximum water pressure of 10,000 psi and a flow rate of about 12 gallons per minute through the nozzle with a traversing distance of up to approximately 20 feet. Other than the piston seal and structural pressure limitations, the invention does not limit the pressure or traversing distance to these values.

Suitable means may be provided for mounting the apparatus described above onto an object to be cleaned (e.g., a heat exchanger) by means known in the art. See, for example, U.S. Pat. No. 4,225,362, which is incorporated herein by reference.

The apparatus described above is particularly suitable for cleaning residue, scale, corrosion, sediment, etc. from tubes in conventional heat exchangers.

The invention has been described in detail with particular reference to preferred embodiments thereof, but it will be understood that variations and modifications can be effected within the spirit and scope of the invention.

We claim:

1. An apparatus for cleaning the interior of elongated tubular objects with pressurized fluid comprising:

(a) a cylinder having opposite closed ends, (b) a double-acting piston mounted for reciprocating motion in said cylinder defining variable volume chambers at each end of said cylinder, (c) a hollow rod fixed to the piston and extending coaxially with the cylinder through an end thereof defining a chamber of said cylinder through which the hollow rod extends, said rod having a nozzle at the end thereof outside said cylinder and openings therein for allowing passage of fluid from said cylinder to the inside of said hollow rod, (d) means providing a fluid seal between said rod and said cylinder end, (e) a first conduit for supplying pressurized fluid to the chamber of said cylinder through which the hollow rod extends, (f) a second conduit for conducting pressurized liquid to and from the others chamber of said cylinder, (g) a connecting conduit having a valve connecting said first and second conduits, (h) said second conduit having a valve downstream from the junction with said connecting conduit, and (i) means for supplying fluid under pressure to said first conduit upstream from its junction with said connecting conduit.

2. The apparatus of claim 1 wherein the valve in said connecting conduit is a throttling valve.

* * * * *